US007360328B2

(12) United States Patent
Fung

(10) Patent No.: US 7,360,328 B2
(45) Date of Patent: Apr. 22, 2008

(54) STEAM GENERATING DEVICE AND IRON USING THE STEAM GENERATING DEVICE

(76) Inventor: Kai Tung Augustine Fung, Unit Q, 7/F., CDW Building, 388 Castle Peak Road, Tsuen Wan, New Territories, Hong Kong (CN)

( * ) Notice: Subject to any disclaimer, the term of this patent is extended or adjusted under 35 U.S.C. 154(b) by 154 days.

(21) Appl. No.: 11/128,735

(22) Filed: May 13, 2005

(65) Prior Publication Data

US 2006/0010727 A1 Jan. 19, 2006

(30) Foreign Application Priority Data

Jul. 14, 2004 (CN) ..... 2004 1 0069745
Jul. 14, 2004 (CN) ..... 2004 2 0073155

(51) Int. Cl.
*D06F 75/06* (2006.01)
*F17C 7/04* (2006.01)

(52) U.S. Cl. ..... 38/77.6; 392/405

(58) Field of Classification Search ..... 38/74, 38/77.1, 77.3, 77.6, 77.7, 77.8, 77.83; 392/405
See application file for complete search history.

(56) References Cited

U.S. PATENT DOCUMENTS 1,958,876 A * 5/1934 Wright ..... 38/77.6
2,851,050 A * 9/1958 Cissell et al. ..... 137/154
3,508,354 A * 4/1970 McCracken et al. ..... 38/77.6
3,823,497 A * 7/1974 Solomon ..... 38/77.6
5,430,963 A * 7/1995 Kuo-Chu ..... 38/77.6
5,832,639 A * 11/1998 Muncan ..... 38/77.6
6,032,391 A * 3/2000 Yao ..... 38/77.6
6,067,403 A * 5/2000 Morgandi ..... 392/401
7,099,571 B2 * 8/2006 Yao ..... 392/405

* cited by examiner

*Primary Examiner*—Ismael Izaguirre
(74) *Attorney, Agent, or Firm*—Alix, Yale & Ristas, LLP

(57) ABSTRACT

The present invention discloses a steam generating device comprising a control circuit for monitoring the temperature and controlling water filling and heating and steam discharging, and a sealed container which is highly temperature resistant. An electric heating tube is mounted in the container and a temperature sensor is mounted on the outer surface of the container. The electric heating tube and the temperature sensor are connected respectively to the control circuit. On the top of the container there is installed a four-way electromagnetic valve, and on the wall of the four-way electromagnetic valve there is installed a water intake tube connected to a water supply. A steam iron using the steam generating device is also disclosed in the present invention, wherein the steam iron can be used together with the steam generating device and has the virtue of continuous water filling steam generation.

10 Claims, 10 Drawing Sheets

STEAM GENERATING DEVICE AND IRON USING THE STEAM GENERATING DEVICE

FIELD OF THE INVENTION

The present invention generally relates to steam generating devices. In particular, the present invention relates to steam generating devices for use with associated irons.

BACKGROUND OF THE INVENTION

Typically, steam irons that are used in residential households, clothing stores, and/or clothing factories can be categorized into three types. The first type includes irons having a small water container and which cannot produce vertically continuous steam. The second type includes irons suitable for use in households and which has an embedded water container. This second type of iron can only be used for a limited period of time, after which time the water container must be filled. The water container cannot be filled while the iron is in operation. This limited operation time is not convenient and steam cannot be supplied immediately and thus, is inefficient.

The third type of irons include those suitable for use in clothing factories. This third type of iron includes two parts: a steam generating device and an iron or spray gun for ironing clothes. The steam generating device is typically a boiler which is used to generate a continuous supply of steam that is directed to the iron or spray gun via a tube for ironing clothes. However, these types of irons are only suitable for use in large-scale clothing factories since they are prohibitively costly and inconvenient for use in residential households due to their large size and heavy components.

Conventionally, a steam generating device and iron that is low in cost and suitable for use in large and medium-sized households and small-sized clothing stores or clothing factories does not exist.

SUMMARY OF THE INVENTION

Briefly stated, a steam generating device of the present invention in a preferred form comprises a control circuit for monitoring temperature, controlling water filling, and generating steam. The steam generating device has a sealed container which is constructed of a high temperature resistant material. An electric heating tube is mounted within the container and a temperature sensor is mounted on the outer surface of the container. The electric heating tube and the temperature sensor are each connected to the control circuit. On the top of the container there is installed a four-way electromagnetic valve on the wall of which there is installed a water intake tube connected to a water supply. The four-way electromagnetic valve is connected to the control circuit.

The ends of the electric heating tube may be directly welded to the inner wall of the container and extend outside of the container.

The electromagnetic valve includes a steam intake. The steam intake is connected to three steam outlets. Spring elements and a rubber plug capable of withstanding pressure are mounted to each of two steam outlets of the three steam outlets. The spring elements and rubber plugs form a pressure release valve on one steam outlet and an overflow valve on the other steam outlet.

A middle portion of the electric heating tube may be attached by welding to the inner wall of the container. The temperature sensor may be mounted on the outer surface of the container at a point corresponding to the position of the welding on the other side of the wall.

The steam iron system in the present invention may comprise a steam generating device, a control circuit and an iron connected to the steam generating device. The steam generating device includes a sealed container which is constructed of a high temperature resistant material. An electric heating tube is mounted within the container and a temperature sensor is mounted on the outer surface of the container. The electric heating tube and the temperature sensor are each connected to the control circuit. On the top of the container there is installed a four-way electromagnetic valve on the wall of which there is installed a water intake tube connected to a water supply. The four-way electromagnetic valve is connected to the control circuit.

The iron may be a steam iron which includes a base plate, an upper housing, and a steam regulating device between the upper housing and the base plate. Both an ordinary steam outlet and a strengthened steam outlet are located on the base plate. Both the ordinary steam outlet and the strengthened steam outlet are connected to the steam regulating device. The steam regulating device is connected to one of the three steam outlets of the four-way valve.

The steam regulating device is provided with a steam intake connected to the four-way valve. The steam regulating device also includes an ordinary steam outlet and a strengthened steam outlet which are respectively connected to the ordinary steam outlet and the strengthened steam outlet mounted on the base plate. The steam intake of the steam regulating device is connected to both of the ordinary steam outlet and the strengthened steam outlet. Located between the ordinary steam outlet, the strengthened steam outlet, and the steam intake is a pushdown regulating rod. The pushdown regulating rod includes a spring element for the restoration of the pushdown regulating rod after being pushed down.

An object of the present invention is to provide a steam generating device that is simple in structure, low in cost, and capable of providing steam continuously and fully.

Another object of the present invention is to overcome the defect of discontinuous steam production as commonly found in conventional irons.

A further objective of the present invention is to provide a steam iron when used with a steam generating device which allows clothes to be ironed continuously with the iron needing substantially no time for an operating condition to be reached. Thus, the iron can be operated efficiently such that it substantially replicates the capacity of a boiler with respect to steam generation.

DETAILED DESCRIPTION OF THE PREFERRED EMBODIMENTS

The detailed description of the preferred embodiment of the present invention shall be described hereinafter with reference to the drawings wherein like numerals represent like parts throughout the views.

Figure 1:
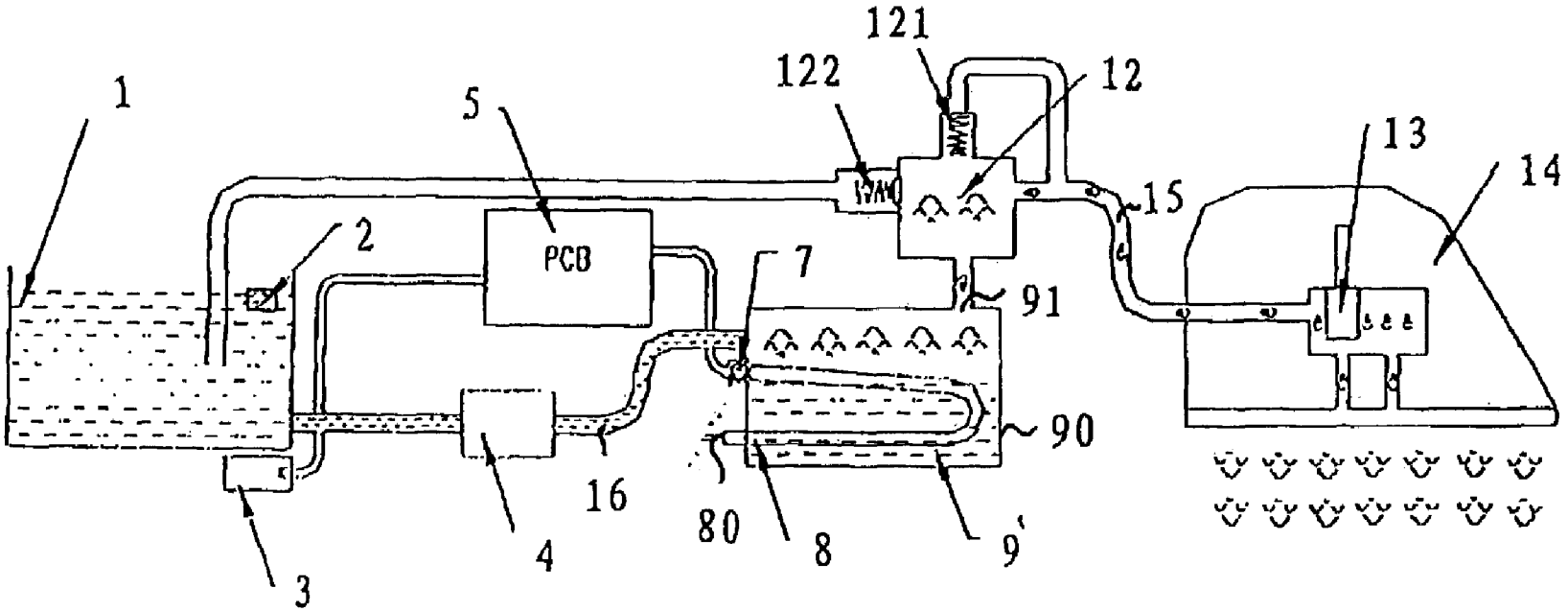
FIG. 1 is a schematic view showing a steam iron consistent with the present invention that is discharging ordinary steam.
Figure 2:
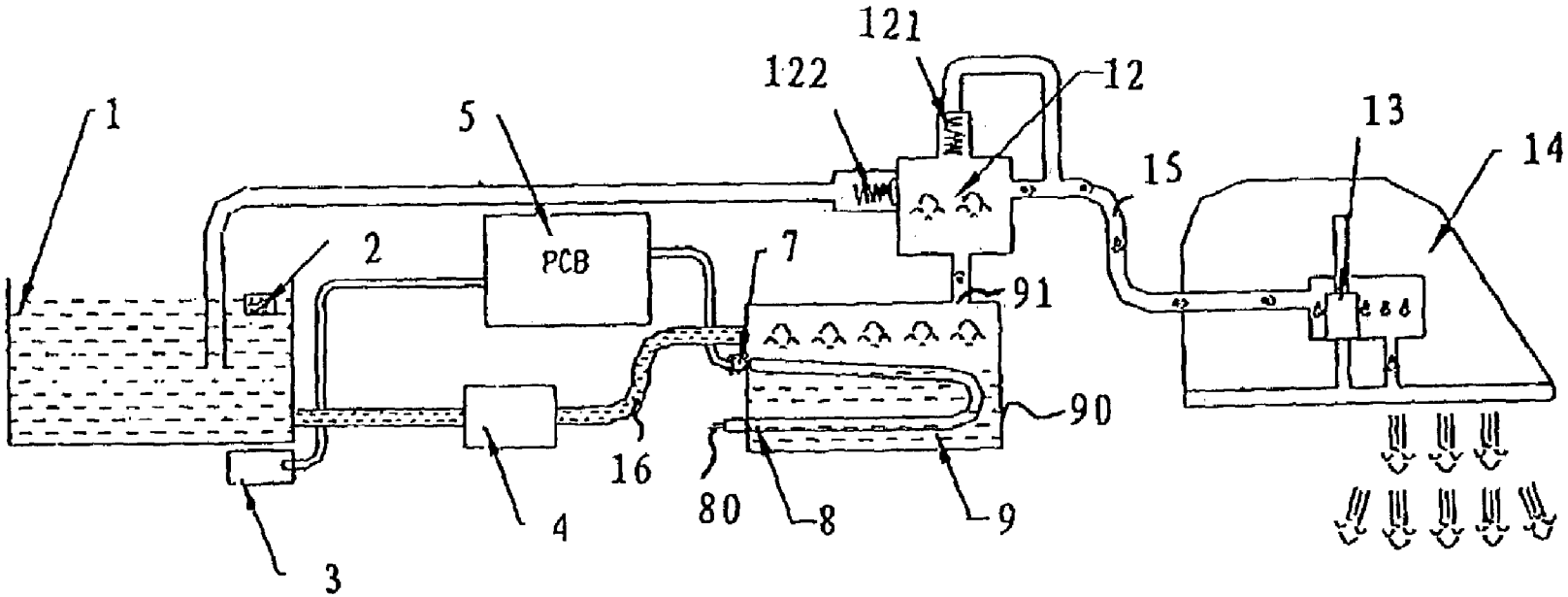
FIG. 2 is a schematic view showing a steam iron consistent with the present invention that is discharging strengthened steam.
Figure 3:
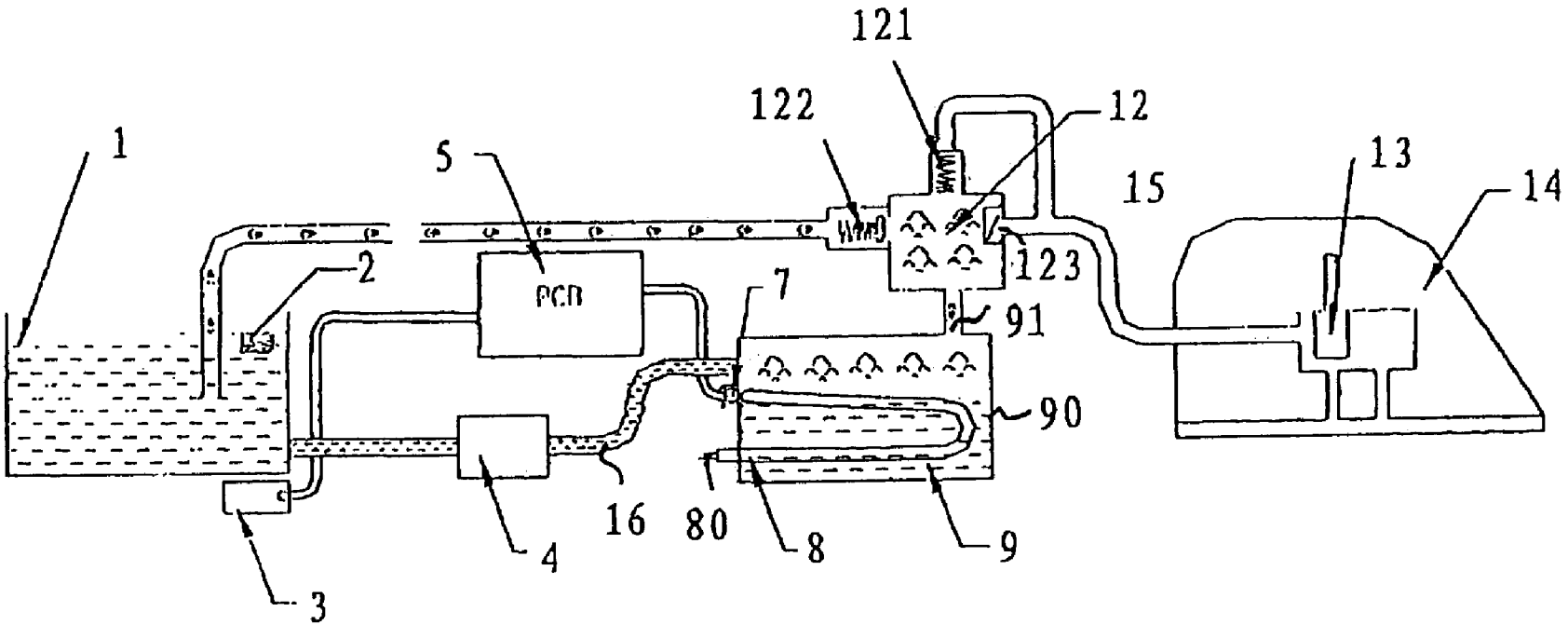
FIG. 3 is a schematic view showing a steam iron consistent with the present invention that is directing steam to a water container.

In one embodiment of the invention, as shown in FIGS. 1 to 3, the steam iron system in the present invention includes a steam generating device 9 and a steam iron 14. The steam generating device 9 and the steam iron 14 are connected by a tube 15 attached to a four-way electromagnetic valve 12. The steam generating device 9 is connected to a cold water container 1 via a second tube 16. The second tube 16 may be connected to a pump 4 such that the pump is intermediate the ends of the second tube 16. A float valve 2 is installed inside the cold water container 1. Located underneath the float valve 2 is a magnetic switch 3. It should be noted that in one embodiment of the invention, the cold water container 1 can be replaced by a water pipe and the float valve 2 and the magnetic switch can be replaced by other control devices to regulate water flow.

Figure 6A:
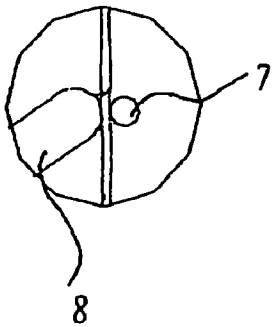
FIG. 6A is an enlarged view of FIG. 6 showing the structure of the welding point of the electric heating tube and the inner wall of the container.
Figure 6:
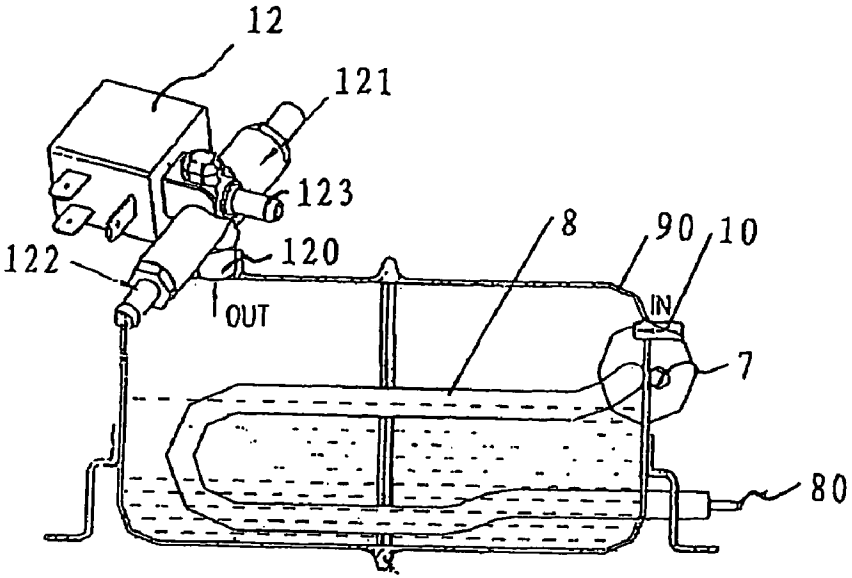
FIG. 6 is a schematic diagram of a steam generating device showing the structure of a welding point of an electric heating tube and an inner wall of a container consistent with the present invention.

As shown in FIGS. 1-3 and 6, the steam generating device 9 includes a sealed container 90 which is constructed of high temperature resistant material. An electric heating tube 8 is mounted within the container 90. The connection end 80 of the electric heating tube 8 extends outside of the container 90 and may be welded to the wall of the container 90. The middle portion of the electric heating tube 8 may also be welded to the wall of the container 90. As shown in FIGS. 6 and 6A, a temperature sensor 7 may be mounted at the location on the outer surface which corresponds to the location adjacent to where the heating tube 8 is welded on the outer surface of the container 90. The temperature sensor 7 and the electric heating tube 8 are connected to the control circuit of a printed circuit board (PCB) 5 via, for example, wires. The operation of the control circuit is responsive to signals from the temperature sensor 7.

In one embodiment of the present invention, the temperature within the device is monitored with a temperature sensor 7 mounted on the outer surface of the device. The temperature sensor 7 generates signals and transmits the signals to the PCB 5 which controls both the operation of the heating tube 8 and the pump 4 inside the steam generating device. When the temperature in the inner part of the steam generating device rises to a preset value, the pump 4 starts to pump water. When the temperature drops below a preset value, due to such things as cold water being added to the device, the pump 4 stops pumping. This regulation of circulation allows the temperature of the steam generating device to be kept within a desired range, for example, at a range where steam is generated continuously. When the water level in the water container reaches a preset low level, a magnetic switch 3 is activated and an indicator is triggered. For example, the control power supply in the PCB 5 may flash an indicator. At the same time, the control circuit of the steam generating device may stop energizing the heating element 8.

As shown in FIG. 6, on the side wall of the container 90 there is a water intake 10 which is connected to the second tube 16. Water can be added to the container 90 under the control of the control circuit which controls the pump 4. On top of the container 90 there is a steam outlet 91 to which a four-way electromagnetic valve 12 is associated.

Figure 7:
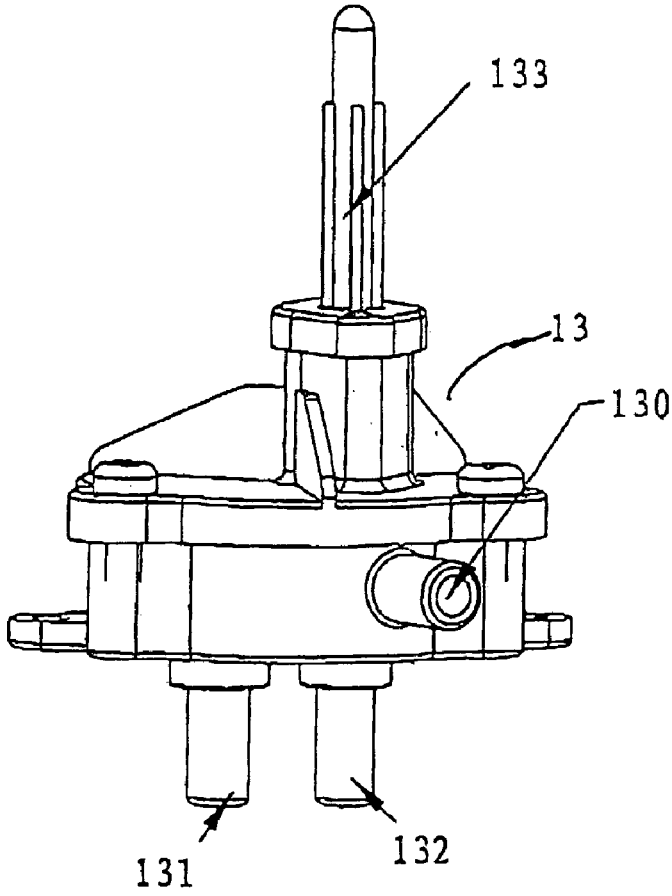
FIG. 7 is a side perspective view of a steam regulating device consistent with the present invention.
Figure 8:
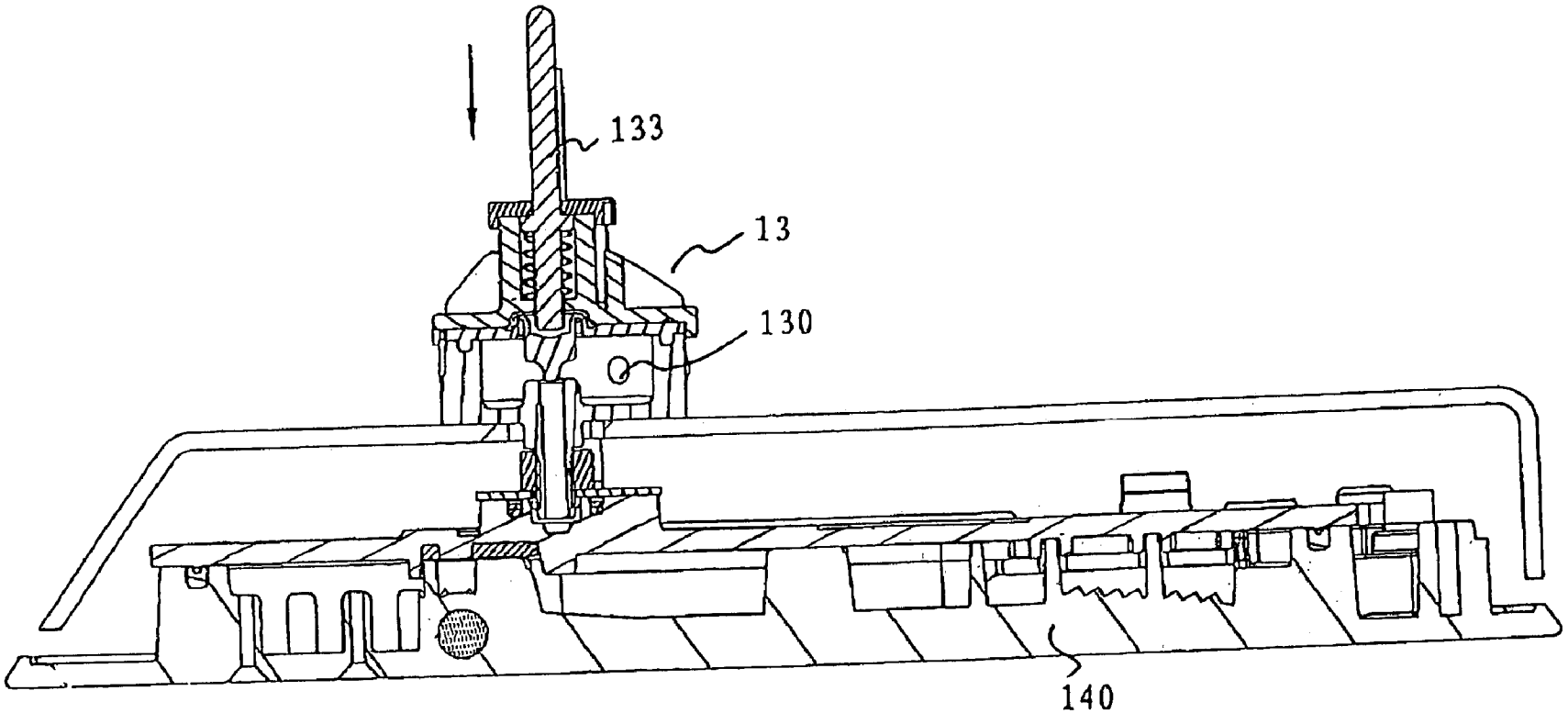
FIG. 8 is a schematic diagram of the steam regulating device consistent with the present invention.
Figure 9:
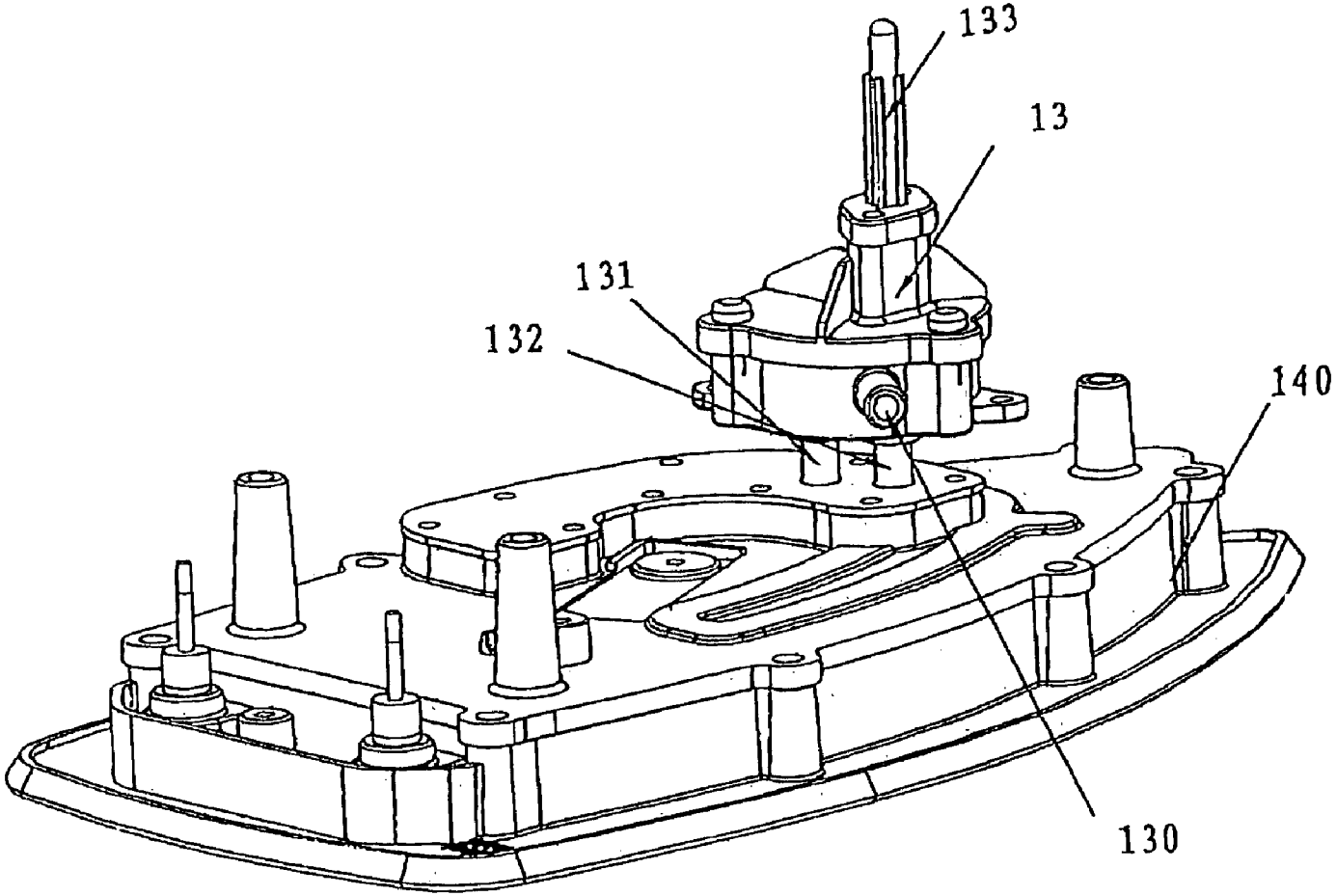
FIG. 9 is an elevated perspective view from the rear quarter of a steam regulating device in association with a base plate consistent with the present invention.
Figure 10:
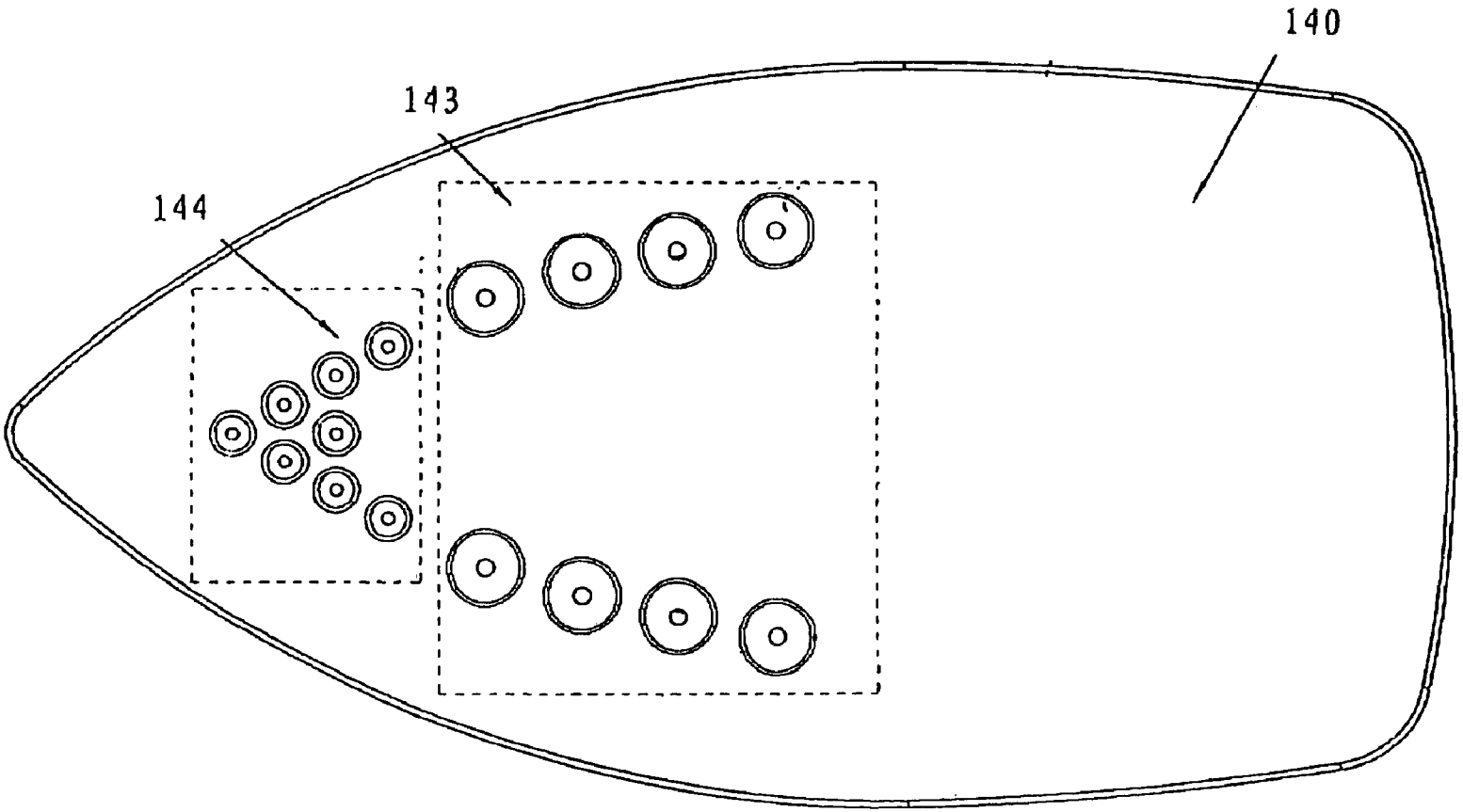
FIG. 10 is a view from below of a base plate consistent with the present invention.

In one embodiment of the present invention, as shown in FIGS. 1 and 2, the steam iron 14 includes a base plate 140, an upper housing and a steam regulating device 13 between the upper housing and the base plate 140. On the base plate 140 there is an ordinary steam outlet 143 and a strengthened steam outlet 144 (shown in FIG. 10). As shown in FIGS. 8 and 9, the steam regulating device 13 has a steam intake 130 which is connected to the tube 15, an ordinary steam outlet 131, and a strengthened steam outlet 132. The ordinary steam outlet 131 and the strengthened steam outlet 132 are respectively connected to the ordinary steam outlet 143 and the strengthened steam outlet 144 on the base plate 140 (shown in FIG. 10). As shown in FIGS. 7 and 9, the steam intake 130 of the steam regulating device 13 is connected to both the ordinary steam outlet 131 and the strengthened steam outlet 132.

In one embodiment of the present invention, A regulating device may be associated with the ordinary steam outlet 131, the strengthened steam outlet 132, and the steam intake 130. The regulating device, as shown in FIG. 8, may include a pushdown regulating rod 133 and a spring element 134 for the positional restoration of the regulating rod 133 to its normal position. When the regulating rod 133 is at its normal position, the steam intake 130 is connected to both the ordinary steam outlet 131 and the strengthened steam outlet 132. When the regulating rod 133 is pushed down, the steam intake 130 is connected only to the strengthened steam outlet 132.

Figure 4:
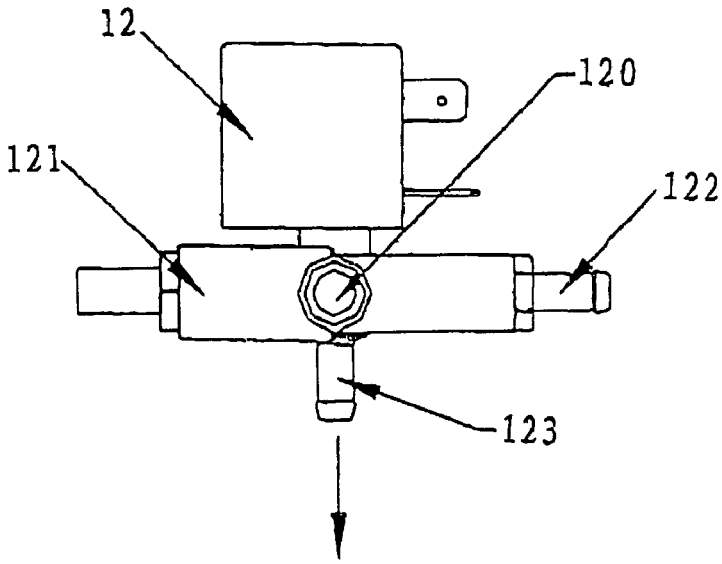
FIG. 4 is a side view of a four-way electromagnetic valve consistent with the present invention.
Figure 5:
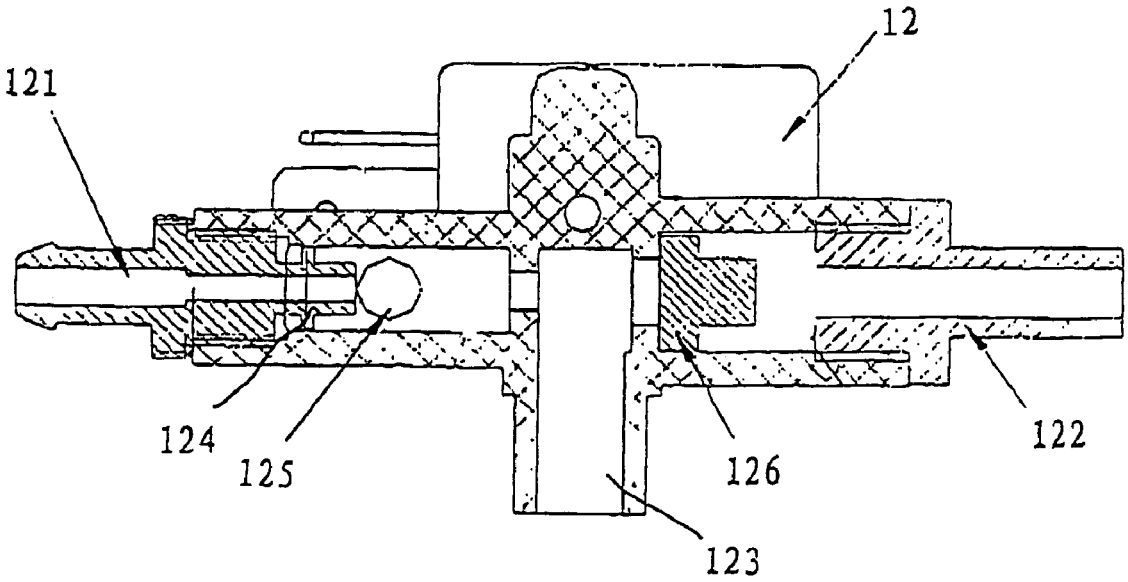
FIG. 5 is a schematic diagram of the four-way electromagnetic valve of the present invention.

As shown in FIGS. 4 and 5, the four-way electromagnetic valve 12 may include a steam intake 120 and three steam outlets 121, 122 and 123. The steam intake 120, in one embodiment of the invention, is connected to the steam outlet 121. As shown in FIG. 5, positioned inside the steam outlet 121 is a silicon rubber plug 124 and spring element 125. Under normal operating conditions, the silicon rubber plug 124 does not seal the steam outlet 121. Under certain pressure conditions, the silicon rubber plug 124 seals the steam outlet 121 and together they form an overflow valve (shown in FIG. 3). Inside the steam outlet 122 there is also a silicon rubber plug 126 and a spring element (not shown) that form a release valve. Under normal conditions, the silicon rubber plug 126 seals the steam outlet 122 and is opened when the pressure of steam reaches a certain value. The opening and closing between the steam outlet 123 and the steam intake 120 is controlled by an electromagnetic valve.

In one embodiment of the present invention, the normal operation of a steam iron is shown in FIG. 1. When the cold water container 1 is filled with water, the float valve 2 activates the magnetic switch 3. The PCB 5 then controls the device. For example, the water pump 4, controlled by PCB 5, begins to pump water through the second tube 16 into the container 90. The PCB 5 then operates to cause the electric heating tube 8 in the container 90 to be energized.

In one embodiment of the invention, the operation of the pump 4 is controlled by the PCB 5 with a change of resistance. The operation of the pump 4 may allow for a continuous circulation wherein the pressure in the container 90 is less than, for example, 0.2 bar. Steam generated in the container 90 by heating tube 8 is discharged through the outlet 91 and into the steam intake 120 of the four-way electromagnetic valve 12. The steam is then discharged through the steam outlet 121.

In one embodiment of the present invention, air in the container 90 is discharged to ensure, when the iron is in a cold condition, that outer air pressure and air pressure inside the container are balanced in order to prevent air pressure caused by change of the steam generating device from a cold state to a hot state due to the cold water being pumped into the steam generating device by the water pump during a preheating of the device. When the preheating time reaches, for example, 2 minutes and 30 seconds (a time value preset in the PCB 5) the steam is discharged out the iron 14. It should be understood that the other time values can be preset in the PCB and that the pressure in the container 90 may be, for example, more than or less than 0.2 bar.

The silicon rubber plug 124, in one embodiment of the invention, seals the steam outlet 121 with the aid of the spring element, the steam outlet 123 is opened and steam is discharged from the container 90 and conveyed to the steam intake 130 of the steam regulating device 13 of the steam iron 14 through the tube 15, then the steam is conveyed to the steam outlet of the base plate 140 of the iron through strengthened steam outlet 132 and ordinary steam outlet 131, as shown in FIG. 1. In this configuration, ordinary steam and strengthened steam is generated. When the regulating rod 133 of the steam regulating device 13 is at a normal up position, the steam comes out from the strengthened steam outlet 132 and the ordinary steam outlet 131. When the regulating rod 133 is pushed down, the ordinary steam outlet 131 is sealed and, as shown in FIG. 2, the steam comes out from only the strengthened steam outlet 132.

As shown in FIG. 3, when the pressure in the container 90 reaches, for example, about 5 bars, the steam outlet 122 in the four-way valve 12 on the top of the container 90 is opened and high-pressure steam is released and is directed to, for example, the cold water container 1 through a water pipe connected to the steam outlet 122.

In one embodiment of the present invention, the operation of the steam iron of the present invention is divided into two stages, stage 1 and stage 2.

Figure 11:
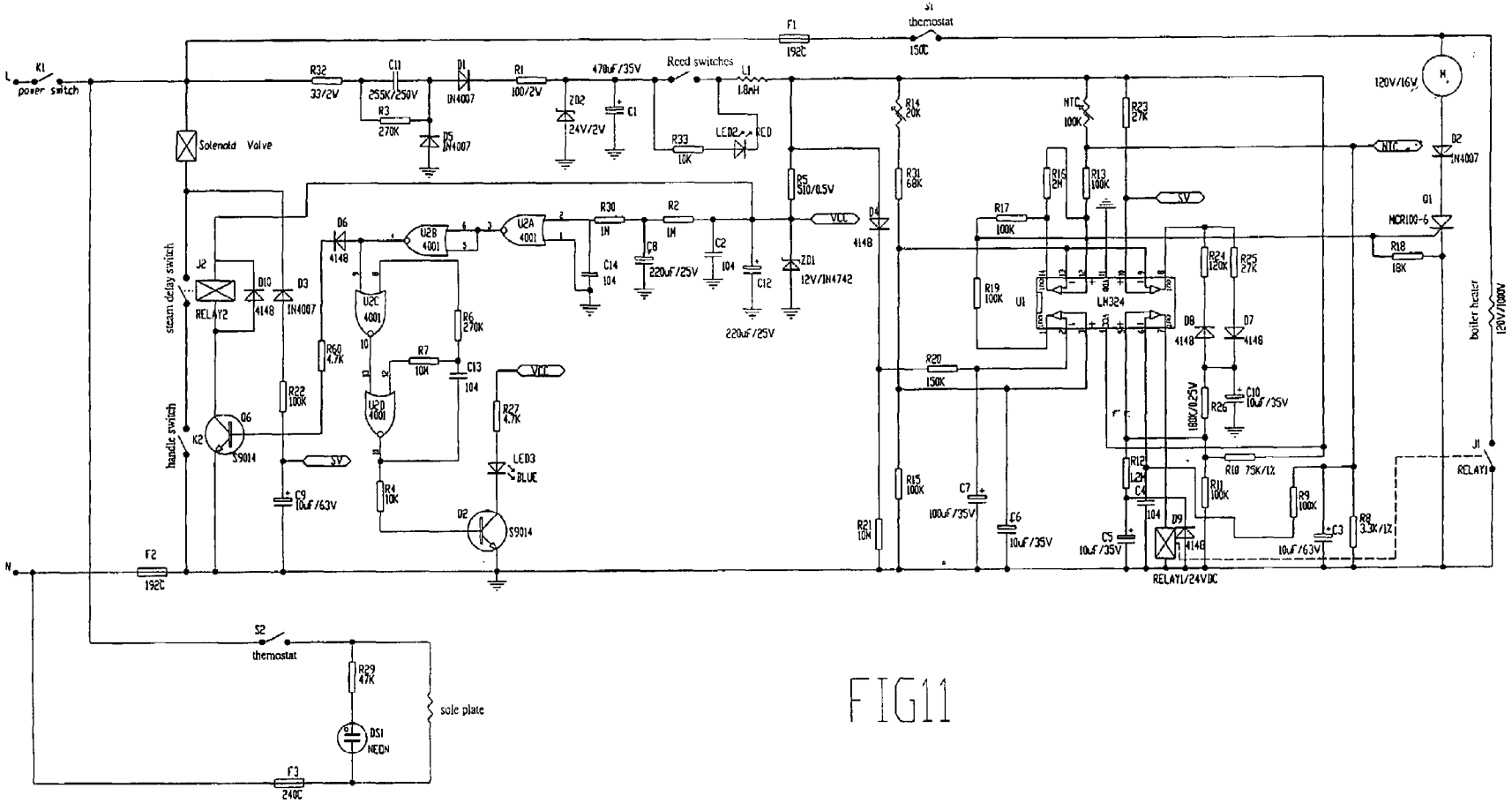
FIG. 11 is a schematic diagram of the control circuit consistent with the present invention.

Stage 1 is the period of time before the steam comes out of the device when, for example, as shown in FIG. 11, the voltage of the 10th leg of an integrated (IC) module 1, for example a Type-LM324 integrated module, is about 15 V, the voltage of the $5^{th}$ leg of the integrated module IC shall be induced to about 12.25 V. When the temperature of the container 90 rises, for example, to about 143°, there is a decrease of the resistance of the temperature sensor 7, and the voltage of the $6^{th}$ leg of the integrated module IC 1 is induced to be more than 12.25 V of the 5th foot of the integrated module IC 1. The $7^{th}$ leg of the integrated module IC 1 is then reversed to a low level and the electric tube 8 in the container 90 is no longer energized. When the temperature of the container 90 falls, for example, to about 131° from about 143°, the resistance of the temperature sensor 7 rises as there is a decrease of the temperature. The voltage of the $6^{th}$ leg of the integrated module IC 1 is then induced to be less than 12.25 V of the $5^{th}$ foot of the integrated module IC. The $7^{th}$ foot of the integrated module IC is then reversed to a high level and the electric tube 8 in the container 90 is energized. In such a circulation, the pressure in the container 90 is kept between about 1.8 to about 3.2 bars.

In one embodiment of the present invention, the PCB 5 is provided with another integrated circuit, for example a Type-4001 integrated circuit, which functions as the protection of the preheating delay. In one embodiment of the present invention, the temperature rise of the container 90 can be sustained for about 2 minutes and 30 seconds from the cold state, and since only the temperature of the container 90 must be increased from the cold state and sustained, the four-way electromagnetic 12 is activated. For example, when the pressure of the steam in the container 90 exceeds 5 bars, the release valve of the four-way electromagnetic 12 starts to operate to release the high-pressure steam in the container 90.

Stage 2, in one embodiment of the invention, is the stage of steam discharge after, for example, a preheating of 2 minutes and 30 seconds, when steam is discharged from the device. For example, when the voltage of the $10^{th}$ leg of the integrated (IC) module 1 is, for example, about 20 V, the voltage of the $5^{th}$ leg of the IC module 1 is induced to about 15.20 V. When the temperature of the container 90 is increased to about 160° by the electric heating tube 8, the water pump 4 begins to pump water. At a point when the temperature of the container 90 is decreased to about 145°, the water pump 4 stops pumping under the control of the IC module 1. However, since the water pumped into the container 90 is cold, the temperature of the container 90 may be decreased further to about 134°. At this lower temperature, the temperature is increased with the heating tube 8 under control of the IC module 1. During the whole process of steam discharge, the electric heating tube 8 stops heating for 3 to 4 seconds only when the temperature is at the highest set temperature, for example, about 160°. When the temperature is lower than, for example, about 160°, the heating tube 8 starts to heat immediately to ensure that there is steam in the container 90 during the whole process.

In one embodiment of the present invention, the steam generating device in the present invention can generate continuously steam in a certain range of temperature and also, the steam generating device can be used together with steam irons and spray guns. During the whole process of ironing, water can be filled in and steam can be generated continuously.

Moreover, the installation of the release valve and the overflow valve in the four-way electromagnetic valve may ensure the safety in operation.

While certain embodiments of the foregoing invention have been set forth for the purposes of illustration, the foregoing description should not be deemed a limitation of the invention herein. Accordingly, various modifications, adaptations and alternatives may occur to one of skill in the relevant art without departing from the spirit and scope of the present invention.

The invention claimed is:

1. A steam generating device comprising:

a control circuit operatively connected to a temperature sensor, a water pump, an electric heating tube, and a steam discharge element;

a temperature resistant container, containing the electric heating tube, said tube having ends and being mounted to an inner portion of the container and the temperature sensor being mounted on an outer surface of the container wherein a portion of the electric heating tube is directly welded to an inner wall surface of the container and wherein the ends of the electric heating tube extend to a region outside of the container;

a four-way electromagnetic valve associated with a top of the container; and a water intake tube connected to a water supply and communicating with the four-way electromagnetic valve.

2. The steam generating device according to claim 1, wherein the four-way electromagnetic valve includes a steam intake and three steam outlets connected to the steam intake, two of said three steam outlets each having a spring element and a rubber plug mounted to each of the two steam outlets, said spring elements and rubber plugs forming respectively a pressure release valve and an overflow valve.

3. The steam generating device according to claim 1, wherein a middle part of the electric heating tube is welded to an inner wall of the container and the temperature sensor is mounted on the outer surface of the container at a point corresponding to the welding.

4. The steam generating device of claim 1 and further comprising a steam iron which includes a base plate, an upper housing and a steam regulating device between the upper housing and the base plate, said base plate having an ordinary steam outlet and a strengthened steam outlet, said ordinary steam outlet and the strengthened steam outlet are individually connected to the steam regulating device and the steam regulating device is connected to one of the steam outlets of the four-way valve.

5. The steam generating device and iron of claim 4, wherein the steam regulating device is provided with a steam intake connected to the four-way electromagnetic valve, an ordinary steam outlet and a strengthened steam outlet connected respectively to the ordinary steam outlet and the strengthened steam outlet mounted on the base plate, said steam intake of the steam regulating device is connected to both of the ordinary steam outlet and the strengthened steam outlet, and between the ordinary steam outlet, the strengthened steam outlet and the steam intake there is a pushdown regulating rod and a spring element which biases the pushdown regulating rod to an up position.

6. A steam generating device and an iron assembly comprising:

a steam generating device having a sealed container and a control circuit, said control circuit being operatively associated with a temperature sensor, a pump, an electric heating tube, and a four-way electromagnetic valve mounted to a top of the container, said electric heating tube being mounted in an interior of the container and said temperature sensor being mounted on an outer surface of the container, said four-way electromagnetic valve having a steam inlet and three steam outlets;

a fluid pathway which includes the pump, a water supply, and a water intake on the sealed container; and a steam iron operatively connected to the four-way electromagnetic valve, and said steam iron includes a base plate, an upper housing and a steam regulating device between the upper housing and the base plate, said base plate having an ordinary steam outlet and a strengthened steam outlet, and wherein the steam regulating device is provided with a steam intake connected to the four-way electromagnetic valve, the ordinary steam outlet and the strengthened steam outlet connected respectively to the ordinary steam outlet and the strengthened steam outlet mounted on the base plate, said steam intake of the steam regulating device is connected to both of the ordinary steam outlet and the strengthened steam outlet, and between the ordinary steam outlet, the strengthened steam outlet and the steam intake there is a pushdown regulating rod and a spring element which biases the pushdown regulating rod to an up position.

7. The steam generating device and iron of claim 6, wherein the iron is a steam spray gun.

8. A steam generating device comprising:

a control circuit operatively connected to a temperature sensor, a water pump, an electric heating tube, and a steam discharge element;

a temperature resistant container, containing the electric heating tube, said tube having ends and being mounted to an inner portion of the container and the temperature sensor being mounted on an outer surface of the container;

a four-way electromagnetic valve associated with a top of the container wherein the four-way electromagnetic valve includes a steam intake and three steam outlets connected to the steam intake, two of said three steam outlets each having a spring element and a rubber plug mounted to each of the two steam outlets, said spring elements and rubber plugs forming respectively a pressure release valve and an overflow valve; and a water intake tube connected to a water supply and communicating with the four-way electromagnetic valve.

9. The steam generating device according to claim 8, wherein a portion the electric heating tube is directly welded to an inner wall surface of the container and wherein the ends of the electric heating tube extend to a region outside of the container.

10. The steam generating device according to claim 8, wherein a middle part of the electric heating tube is welded to an inner wall of the container and the temperature sensor is mounted on the outer surface of the container at a point corresponding to the welding.

* * * * *